United States Patent [19]

Rear

[11] 4,015,670

[45] Apr. 5, 1977

[54] FLUID OPERATED HAMMER

[76] Inventor: Ian Graeme Rear, 53 Louise St., Nedlands, Perth, Australia, 6000

[22] Filed: Sept. 5, 1975

[21] Appl. No.: 610,809

[30] Foreign Application Priority Data

Sept. 6, 1974 Australia ..... 8797/74

[52] U.S. Cl. ..... 173/15; 173/66; 173/73

[51] Int. Cl.[2] ..... E21B 5/00; E21C 7/00

[58] Field of Search ..... 173/17, 73, 78, 64, 173/65, 66, 80, 136

[56] References Cited

UNITED STATES PATENTS

| | | | |
|---|---|---|---|
| 2,887,989 | 5/1959 | Dulaney | 173/17 X |
| 3,225,841 | 12/1965 | Thompson | 173/73 X |
| 3,826,316 | 7/1974 | Bassinger | 173/17 |
| 3,896,886 | 7/1975 | Roscoe, Jr. | 173/17 |

*Primary Examiner*—Ernest R. Purser
*Assistant Examiner*—William F. Pate, III
*Attorney, Agent, or Firm*—William A. Drucker

[57] ABSTRACT

A fluid operated hammer for rock drills comprising; a cylinder, a drill chuck mounted at one end to receive a drill bit; a drill sub attached to the other end; a tubular fluid feed tube mounted in the drill sub and extending towards the chuck, the longitudinal central axis of the feed tube corresponding to the longitudinal central axis of the cylinder; at least one set of apertures provided in the side wall of the feed tube and spaced from each end; a piston slidably mounted in the cylinder and over the feed tube to move between the drill chuck and drill sub the lower end being adapted for striking a portion of the drill bit extending through the drill chuck; a first passageway in said piston communicating with one end face thereof and opening into the center of the piston at a location spaced along the length of said piston; a second passageway in said piston communicating with the end face of the piston communicating with the end of the piston opposite to that of the first passageway and opening into the center of the piston at a location spaced along said piston, said first passageway communicating with one of said set of apertures in the feed tube when the piston is in abutting relationship with the chuck to admit fluid into the space between the piston and drill chuck to drive the piston upwards and said second passageway communicating with one of said set of apertures when the piston is at its upper position in the cylinder to admit fluid into the space between the piston and drill sub to drive the piston downwards.

11 Claims, 12 Drawing Figures

FLUID OPERATED HAMMER

This invention relates to a fluid operated downhole hammer for use in earth and rock drilling and boring operations.

In one form the invention resides in a fluid operated hammer for rock drills comprising a cylinder, a drill chuck mounted at one end to receive a drill bit and a drill sub attached to the other end, a tubular fluid feed tube mounted in the drill sub and extending towards the chuck, the longitudinal central axis of the feed tube corresponding to longitudinal central axis of the cylinder, at least one set of apertures provided in the side wall of the feed tube and spaced from each end, a piston slidably mounted in the cylinder and over the feed tube to move between the drill chuck and the drill sub, the lower end being adapted for striking a portion of the drill bit extending through the drill chuck; a first passageway in said piston communicating with one end thereof and opening into the centre of the piston at a location spaced along said piston, a second passageway in said piston communicating with the end of the piston opposite to that of the first passageway and opening into the centre of the piston at a location spaced along said piston, said first passageway communicating with said set of apertures in the feed tube when the piston is in abutting relationship with the chuck to admit fluid into the space between the piston and drill chuck to drive the piston upwards and said second passageway communicating with said set of apertures when the piston is at its upper position in the cylinder to admit fluid into the space between the piston and drill sub to drive the piston downwards.

The invention will be more fully understood in the light of the following description of two specific embodiments thereof. The embodiments will be described with reference to the accompanying drawings of which:

Figure 1:
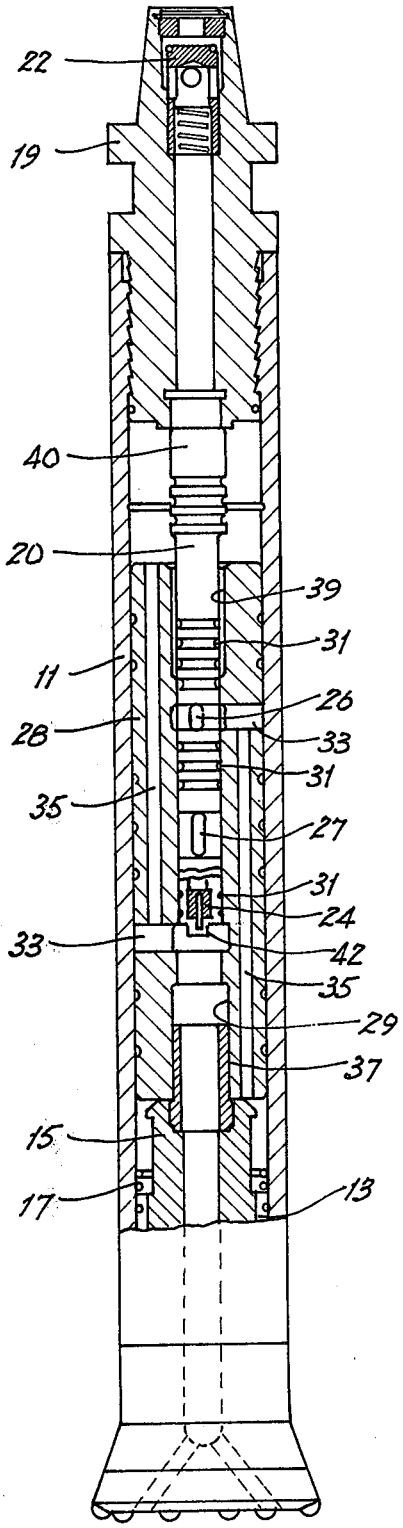
FIG. 1 is a sectional elevation of the first embodiment.

The first embodiment is directed to a pneumatic hammer for earth drilling. The embodiment comprises a cylinder 11 with a drill chuck 13 mounted at one end. The drill chuck 13 is intended to receive a drill bit 15 which is retained in the drill chuck by slip bit retaining rings 17. The mounting and design of the drill bit and drill chuck is such that when fitted into the cylinder there is a limited amount of longitudinal movement provided between the drill bit 15 and drill chuck 13. The cylinder 11 is connected at its upper end to a compressed air supply via a drill sub 19 at its top end which has a feed tube 20 mounted in it. The drill sub is provided with a check valve 22 to prevent a fluid back flow from the cylinder. The feed tube 20 extends from the drill sub 19 towards the chuck but terminates just above the drill bit 15. The longitudinal central axis of the feed tube 20 corresponds with the longitudinal central axis of the cylinder 11. The end of the feed tube adjacent the drill bit is plugged with a reduced diameter plug 24 to reduce the fluid flow from the end of the feed tube 20. Two sets of apertures 26 and 27 are provided in the wall of the feed tube and are spaced circumferentially around the tube at the same longitudinal spacing from one end of the feed tube 20.

An annular shaped piston 28 is slidably mounted in the cylinder 11 such that it can move between the drill bit 15 and the drill sub 19 over the feed tube 20. Sealing means 31 are provided on the feed tube between the feed tube and piston adjacent either side of the apertures therein.

Figure 2:
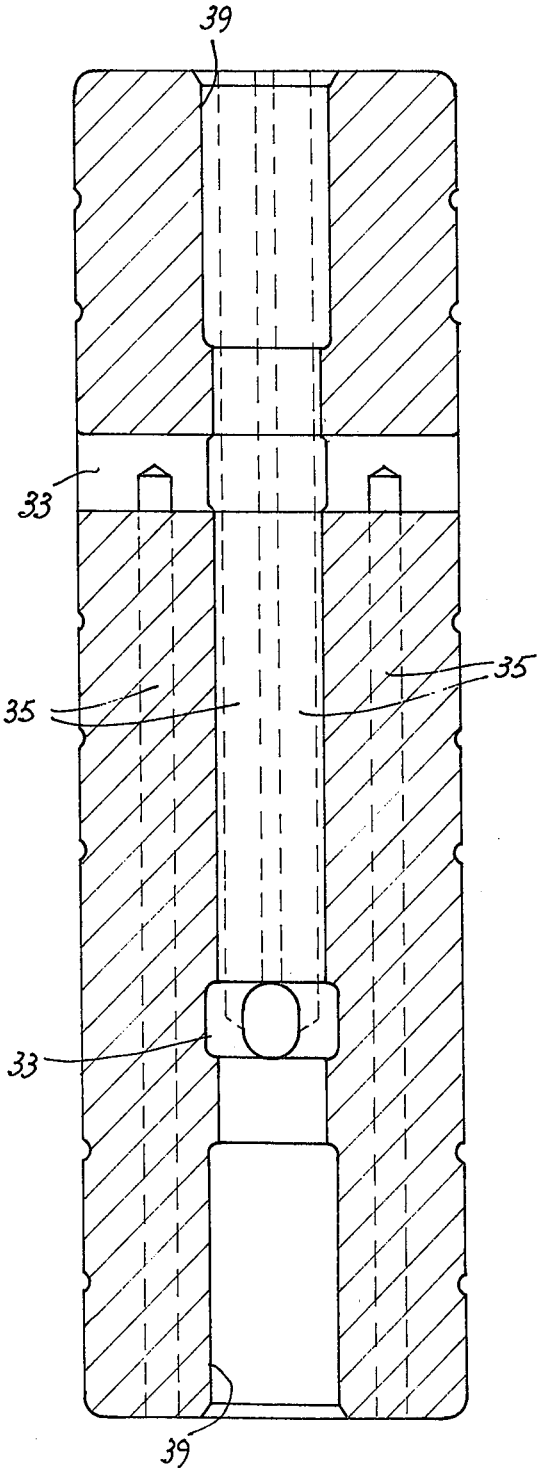
FIG. 2 is a sectional elevation of the piston of the first embodiment.
Figure 3:
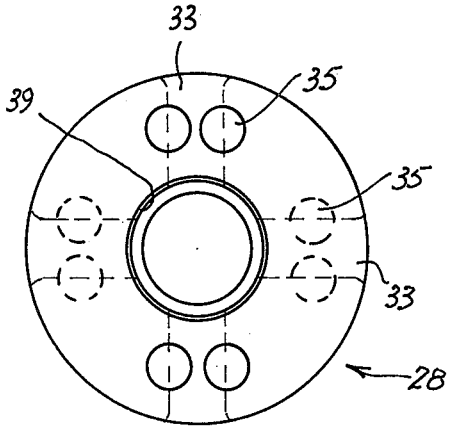
FIGS. 3 and 4 are end views of the piston shown in FIG. 2.
Figure 4:
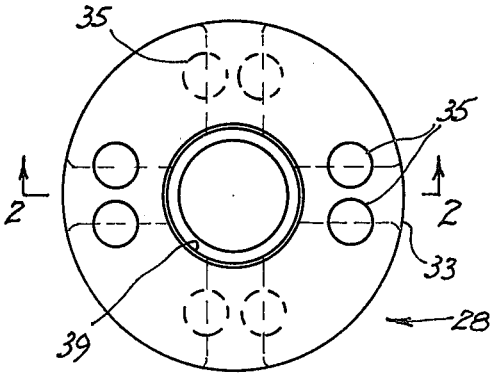

The piston 28 as may be more clearly seen from FIGS. 2, 3 and 4 has formed therein two spaced diametric apertures 33 extending through the piston each aperture has communication with two pairs of longitudinal passageways 35 which provide fluid communication with an end face of the piston. The passageways 35 interconnect the end face furthermost from the respective aperture 33. Each set of passageways comprise two pairs symmetrically positioned around the central longitudinal axis of the piston 28. It will be appreciated that there is some discrepancy between the piston as shown in FIGS. 1, 5, 6 and 7 and that shown in FIGS. 2, 3 and 4. The discrepancy is intentional and is in order that the relative arrangements of components as shown in FIG. 1 may be understood and that the operation of the device may be understood in relation to FIGS. 5, 6 and 7.

Figure 5:
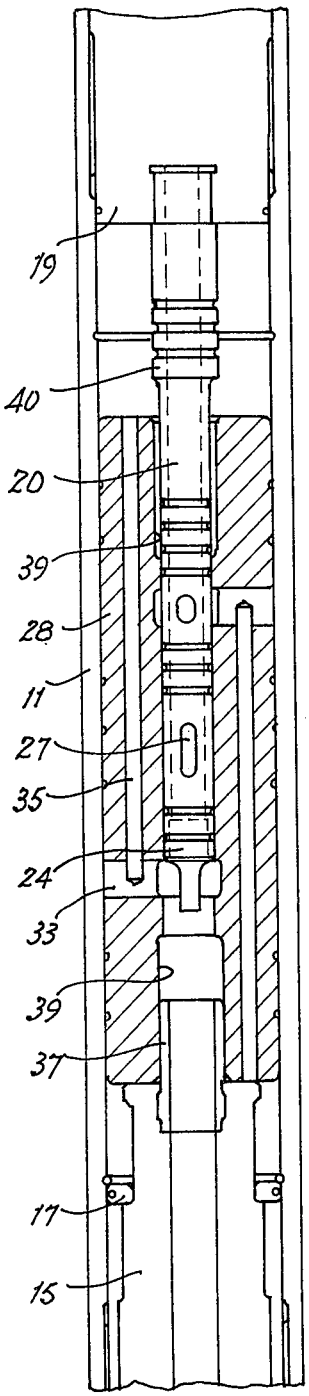
FIG. 5 is a cross-section of the first embodiment in the operative position with the piston at its lowermost position.
Figure 6:
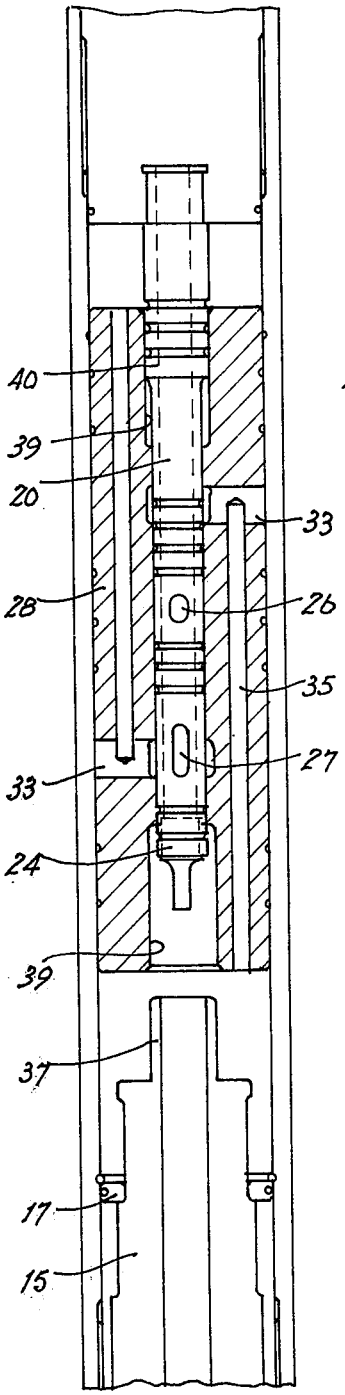
FIG. 6 is a cross-section of the first embodiment in the operative position with the piston in its raised position.
Figure 7:
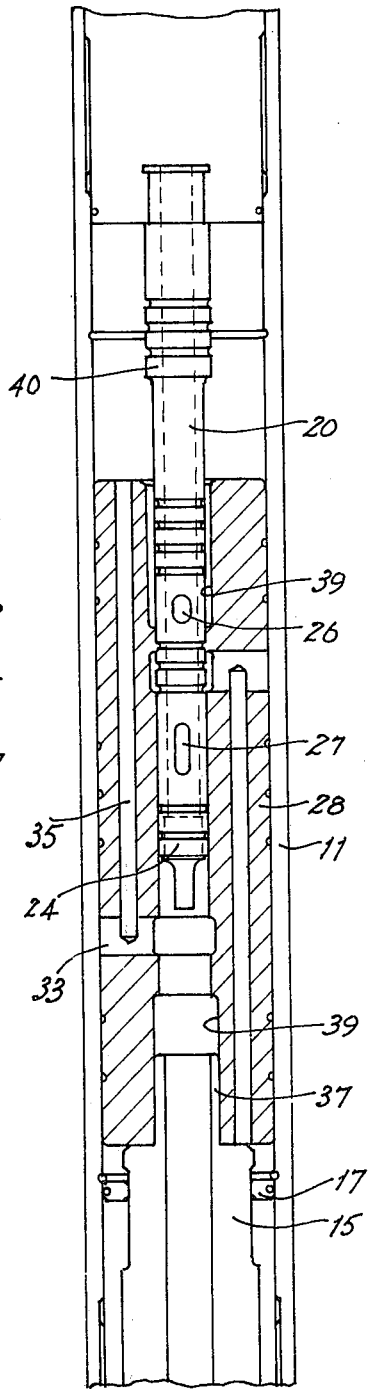
FIG. 7 is a cross-section of the first embodiment in the in-operative position.
Figure 8:
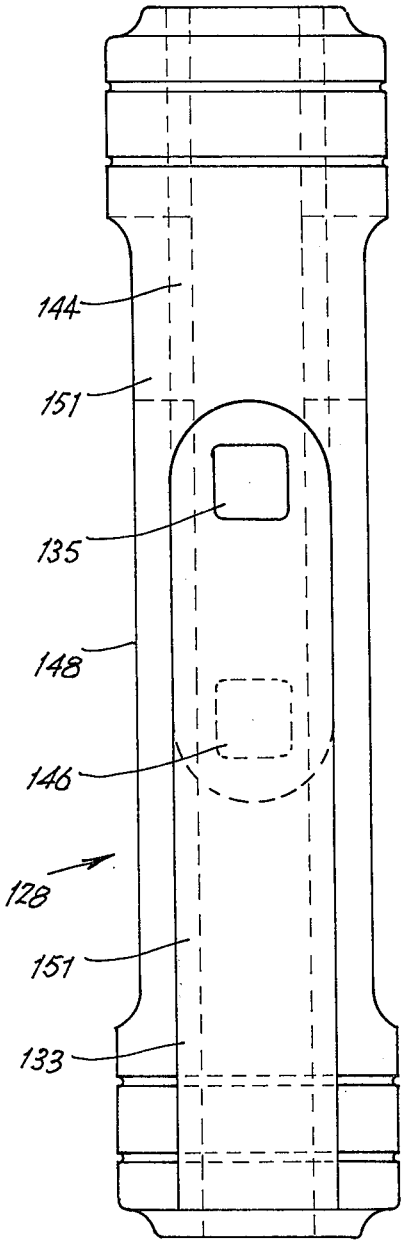
FIG. 8 is an elevation of a piston of the second embodiment.
Figure 9:
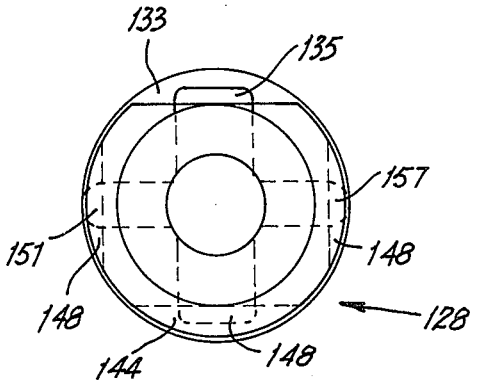
FIG. 9 is an end view of the piston of FIG. 8.
Figure 10:
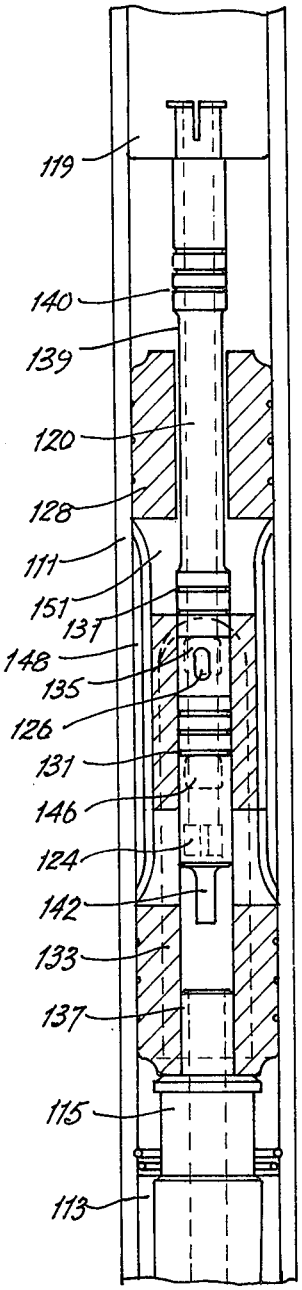
FIGS. 10, 11 and 12 is a sectional elevation of the hammer of the second embodiment illustrating the three basic operative positions of the piston.
Figure 11:
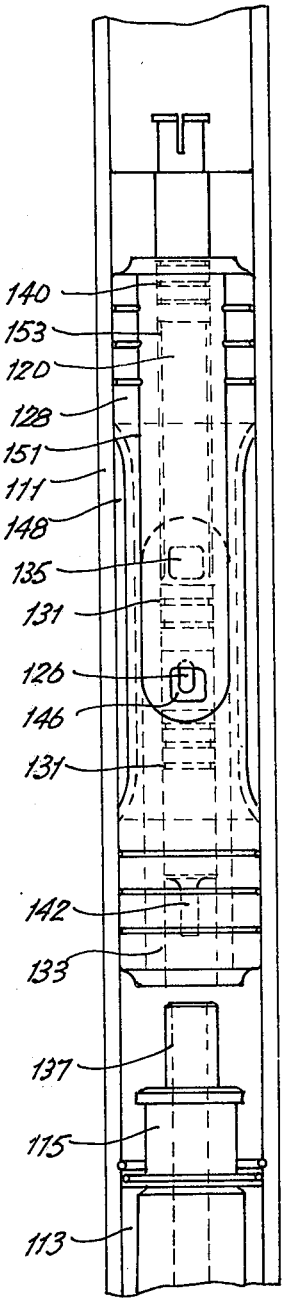
Figure 12:
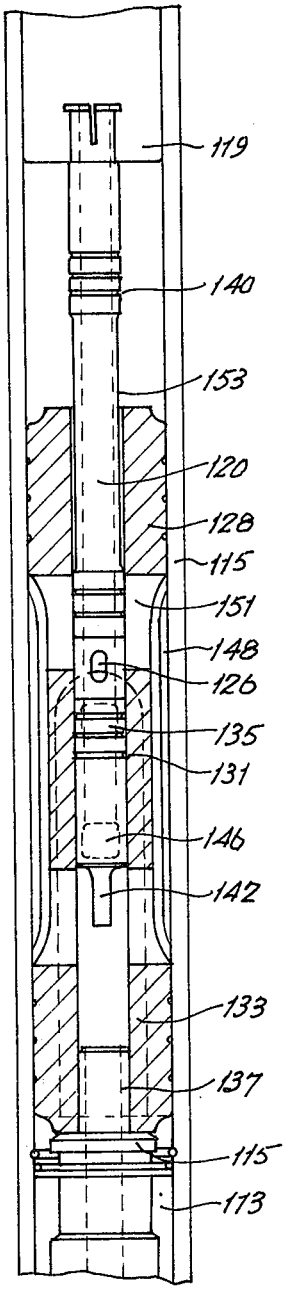

The operation of the hammer may be more fully understood in the light of FIGS. 5, 6 and 7. FIG. 5 illustrates the piston 28 at its lowermost position against the drill bit 15. The upper end of the drill bit 15 is provided with an upwardly extending spigot 37 which is sealingly engaged by the adjacent enlarged bore 39 of the piston, said enlarged bore 39 being provided at both ends of the piston. When the piston is in its lowermost position as shown in FIG. 5 the uppermost diametric aperture 33 in the piston 28 is adjacent the uppermost aperture 26 in the feed tube 20. In addition the lowermost diametric aperture 33 in the piston 28 is in communication with the space between the end of the feed tube and the drill bit and so provides fluid communication between the volume above the upper end of the piston 28 and that space. As a result of such an interrelationship between the piston and feed tube, high pressure air is forced into the sealed space between the lower end of the piston and the drill bit 15 and spigot 37 thereof to drive the piston upwards. Any air displaced by upward movement of the upper end of the piston is initially forced down the passageways 35 opening into the upper face of the piston and into the drill bit until such time as the enlarged bore 39 of the upper end of the piston sealingly engages an enlarged upper portion 40 of the feed tube. The remaining volume of air trapped by the upper end of the piston as a result of such sealing engagement provides a cushioning between the upper end of the piston 28 and drill sub 19 to retard the further upward movement of the piston 28.

When the piston is at its uppermost position as observed in FIG. 6 the lowermost aperture 33 in the piston 28 is adjacent the lowermost set of apertures 27 in the feed tube 20 and through passageway 35 these are in fluid communication with the sealed volume above the upper end of the piston 28. The upper diametric aperture 33 is in sealing engagement with the feed tube 20. As a result of this relationship between the piston 28 and feed tube 20 high pressure air is admitted to the volume above the piston to drive the piston 28 down the cylinder and onto the drill bit 15. Any air initially displaced by this downward movement of the piston will escape through the drill bit until the enlarged bore 39 of the piston sealingly engages the spigot 37 of the drill bit.

If it is desired to cease hammering the drill stem is raised to permit the drill bit 15 to drop in the chuck 13 to its lowermost position where it is supported by the bit retaining ring 17 (see FIG. 7). As a result of the drill bit 15 being lower in the cylinder than during the hammering operation, when the piston 28 abuts up against the drill bit 15 the upper aperture 33 in the piston is sealingly engaged on the feed tube between the apertures 26 and 27 to prevent any air flow into the space at the lower end of the piston. In addition the lower aperture is located between the end of the feed tube 20 and the spigot 37. The enlarged bore portion 39 at the upper end of the piston is located adjacent the upper set of apertures 26 on the feed tube 20. As a result air from the apertures 26 flows into the space defined above the upper end of the piston 28, down the passageways 35 through the lower aperture 33 and out of the drill bit 15. Thus it is apparent that by raising the drill stem and permitting the drill bit to drop in the chuck not only is the hammer deactivated but also the flow of air through the bit can be increased to clear cuttings from the area of the bit at the bottom of the hole.

During normal operation of the hammer the air flow is a pulsating flow as the air used to drive the piston up or down is vented to the drill bit. The restricted bore plug 24 provides a continuous flow to the bit and this is regularly supplemented by the air from the hammer drive. It may be preferable in some instances to completely seal the end of the feed tube 20 to completely restrict the air flow to the drill bit to that from the hammer drive.

As may be observed from the drawings the plug 24 has an extension 42 to direct the air stream therethrough directly into the spigot 37 of the drill bit. The effect of such an action is to assist in scavenging the air from the space between the feed tube and bit and the other periodically connected spaces.

As may be also observed from the drawings the lower set of apertures 27 on the feed tube are larger than the upper set of apertures 26. The reason for such a difference in size is to facilitate maximum downward thrust upon the piston. The same thrust is not required to raise the piston 28.

The second embodiment as seen in FIGS. 8 to 12 is similar to the first with variations to the structure of the piston and feed tube.

An annular shaped piston as in the first embodiment 128 is slidably mounted in the cylinder 111 such that it can move between the drill bit 115 and the drill sub 119 in the air conduit over the feed tube 120. Sealing means 131 are provided on the feed tube 120 between the feed tube and piston 128 adjacent either side of the set of apertures 126 therein. The outer periphery has a longitudinal slot 133 cut along part of the length of the piston and communicating with the chuck end of the piston. The piston has an aperture 135 formed in the slotted portion 133 which communicates with the exterior of the feed tube 120. The aperture is positioned such that when the piston 128 is in abutting relationship with the drill bit 115 there is communication between the set of apertures 126 in the feed tube, the aperture 135 in the slotted portion 133 of the piston and the drill bit end of the piston. A second longitudinal slot like portion 144 is provided in the periphery of the piston cut part way along the length of the piston and communicating with the drill sub 119 or top end of the piston. A second aperture 146 is provided in the piston in the second slotted portion wherein the aperture 146 communicates with the exterior of the feed tube. When the piston has reached a position adjacent the top end of the cylinder the second aperture 146 aligns with the apertures 126 in the feed tube 120 to provide communication between the interior of the feed tube and the top end of the piston. A third longitudinal slot 148 is provided on the periphery of the piston the length of the slot is shorter than the length of the piston and the slot is positioned centrally. Each end of the slot has an aperture 151 extending through the annular wall of the piston. Sealing means are provided on the piston between the piston and the interior of the cylinder to prevent any air leakage between the ends of the piston. The drill bit 115 is provided with an upwardly directed annular spigot 137 slidably extending through the drill chuck which is intended to be sealingly engaged by the annular walls of the piston 128 when in its lowest position but is free when the piston is in its uppermost position. The upper end of the spigot 137 is spaced from the lower end of the feed tube 120.

In describing the operation of the embodiment the piston 128 shall be taken as initially in its lowermost position. When it is desired to have the air hammer operating down pressure is placed upon the cylinder forcing the bit to protrude fully into the cylinder. With the piston in its lowest position compressed air passes from the interior of the feed tube through the apertures 126 therein and the aperture 135 in the first slot 133 in the piston, to the first slot 133 in the piston and to the bit end of the piston. As a result of the build up in pressure on the bit end of the piston the piston is driven upwards. Air which may be trapped between the drill sub 119 and the corresponding end of the piston 128 is permitted to escape through a reduced diameter portion 153 of the feed tube to the upper aperture 151 in the third slot 148 on the piston to the lower aperture 151 in the third slot 148 and to the internal space formed between the end of the bit spigot 137, the end of the feed tube 120 and the annular walls of the piston 128 and out through the bit spigot into the drill bit 115.

Upon the piston being driven to nearly its uppermost position the bit end of the piston clears the end of the bit spigot 137 to permit the compressed air driving the piston upwards to be vented to the drill bit 115. When the piston reaches its uppermost position the upper end of the piston engages a seal 140 on the feed tube. The purposes of the seal is to prevent leakage of the air above the upper end of the piston. When at its uppermost position the aperture 146 in the second slotted portion 144 mates up with the apertures 126 in the feed tube to permit compressed air to enter the space above the piston and force the piston downwards. Upon the piston being forced to its lowest position the process is repeated. When at its lowest position the compressed air above the piston is permitted to escape via the reduced diameter portion 153 of the feed tube 120, the third slot 148 and into the bit spigot 137 and then to the drill bit orifices.

When it is desired to cease the hammering action of the air hammer and to blow air into the region of the drill hole and for the purpose of clearing the cuttings, the cylinder 111 is lifted a small amount from the bottom of the hole. As a result of the mounting of the drill bit 115 to the end of the chuck 113 the drill bit is permitted to move downwards with respect to the cylinder to be retained by the bit retaining rings 117. When the piston 128 drops to its lowermost position abutting agains the drill bit 115 the piston is then in a lower position with respect to the feed tube 120 than during hammering operations. As a result the upper aperture 151 of the third slot 148 is in communication with the apertures 126 in the feed tube and the lower aperture 151 of the third slot communicates with the space between the end of the feed tube 120 and the bit spigot 137. Because of this communication air is permitted to flow from the feed tube directly to and through the drill bit 115 in order to clear the cuttings from the area of the bit in the bottom of the hole and adjacent to the outer walls of the cylinder and drill pipe above the assembly.

As indicated in the first embodiment during the operation of the hammer the air flow is a pulsating flow as the air used to drive the piston either up or down is vented to the drill bit, but as a result of the restricted flow plug 124 there is a continuous flow of air to the drill bit the magnitude of which varies. The effect of the extension 142 would be to prevent back pressure on the chuck side of the piston when the piston is being forced downwardly. In addition as stated previously the air flow from the extension may have a scavenging effect to remove the air from the space between the feed tube and bit and the other periodically connected spaces.

In forming the piston the communication of the first and second slots 133 and 144 may communicate directly with the bit end or the drill sub end. Alternatively the portions may communicate with a circumferential groove at the end of the piston which may communicate with the space at the end of the piston through a series of holes formed in the collar between the circumferential groove and the end of the piston. A further alternative comprises the same circumferential groove and a slot between the groove and the end of the piston, diametrically opposite the main slotted portion. The advantage of the latter two alternatives over the first is that such an arrangement prevents any sideways kick or movement of the piston in its up and down movement.

It will be appreciated that one of the main advantages of this invention is the minimal amount of machining required in the production of the component parts. The only components requiring any specialised machining are the piston and feed tube. In addition as there is not specialised shape required of the internal surface of the cylinder the striking surface of the piston and mass of the piston may be maximised Furthermore both the piston and cylinder are fully reversible either together or separately.

I claim:

1. A fluid operated hammer for rock drills, comprising:

a cylinder;

a drill chuck mounted at one end of said cylinder to receive a drill bit;

a drill sub attached to the other end of said cylinder;

a tubular fluid feed tube mounted in the drill sub and extending towards the chuck, the longitudinal central axis of the feed tube corresponding to the longitudinal central axis of the cylinder;

at least one set of apertures provided in the side wall of the feed tube and spaced from each end;

a piston slidably mounted in the cylinder and over the feed tube to move between the drill chuck and drill sub, the lower end being adapted for striking an anvil portion of the drill bit extending through the drill chuck;

a first passageway in said piston communicating with one end face thereof and opening into the centre of the piston at a location spaced along the length of said piston;

a second passageway in said piston communicating with the end face of the piston communicating with the end of the piston opposite to that of the first passageway and opening into the centre of the piston at a location spaced along said piston;

the central bore of the piston having at each end of a counterbored portion, the remaining length of the central bore being of uniform diameter corresponding substantially to that of the feed tube, wherein said piston is symmetrical about its central diametric axis to be reversible in the cylinder without affecting the function thereof;

said drill bit being capable of limited longitudinal movement in the drill chuck and said anvil portion being formed with an upwardly directed annular spigot intended to be sealingly engaged by the adjacent counterbore of the piston when the piston and anvil portion are in abutting relationship;

one of said passageways communicating with one of said set of apertures in the feed tube when the piston is in abutting relationship with the anvil portion and said drill bit portion occupies its innermost position in respect of the chuck; to admit fluid into the space between the piston and drill chuck to drive the piston upwards;

the other of said passageways communicating with one of said set of apertures, when the piston is at its upper position in the cylinder and said drill bit portion occupies its innermost position in respect of the chuck, to admit fluid into the space between the piston and drill sub to drive the piston downwards; and wherein when said drill bit is at its outermost position in respect of the chuck, the piston is maintained at its lowermost position abutting the anvil position, the upper counterbore is in communication with one of said set of apertures and said second fluid passageway provides communication between the uppermost end of the piston and the space between the end of the feed tube and the drill bit.

2. A fluid operated hammer as claimed in claim 1 wherein the drill bit is slidably mounted in the drill chuck for limited longitudinal movement therein, wherein when said drill bit is at its uppermost position in the drill chuck the respective passageways in the piston have communication with the respective apertures in the feed tube when the piston is in its lower and upper positions in the cylinder; and wherein when said drill bit is at its lowermost position in the drill chuck and the piston is abutting the drill chuck the hammer is in a bypass condition wherein; the fluid passageway communicating with the space between the piston and drill chuck is sealed and the fluid from at least one of said set of apertures is permitted to flow continuously to the drill bit.

3. A fluid operated hammer as claimed in claim 2 wherein the upper end of the drill bit is provided with an annular spigot centrally thereof and extending upwardly therefrom, said spigot being sealingly engaged by the lower counterbored end of the piston for a portion of its movement within the cylinder.

4. A fluid operated hammer as claimed in claim 3 wherein the lower end of the tubular feed tube is provided with a restricted fluid passageway.

5. A fluid operated hammer as claimed in claim 4 wherein each of said passageways comprise a plurality of symmetrically located longitudinal bores in the piston extending from the respective end face of the piston to at least one diametric apertures in the piston providing access to centre of the piston.

6. A fluid operated hammer as claimed in claim 5 wherein said feed tube is provided with two sets of spaced apertures the upper set of apertures communicating with said first passageways when the piston is abutting the drill chuck and said lower set of apertures communicating with said second passageway when the piston is in its upper position.

7. A fluid operated hammer as claimed in claim 6 wherein when the hammer is in the bypass condition the upper set of apertures is in direct communication with the space between the piston and drill sub, the lower set of apertures is sealed by the piston, the first passageway is sealed by the feed tube and the second passageway is in open communication between the space between the piston and drill sub and the drill bit.

8. A fluid operated hammer as claimed in claim 7 wherein said passageways are formed as at least one slot in the side of the piston extending from the respective end face of the piston to at least one radial aperture providing access to the centre of the piston.

9. A fluid operated hammer as claimed in claim 8 wherein there is one set of apertures in the feed tube.

10. A fluid operated hammer as claimed in claim 9 wherein a third longitudinal passageway is provided in the piston, said passageway extending longitudinally in the piston and terminating short of each end of the piston, said third passageway providing fluid communication between at least one set of apertures in the feed tube and the drill bit when the hammer is in the bypass condition.

11. A fluid operated hammer as claimed in claim 10 wherein said third passageway provides communication between the drill bit and the space between the piston and drill sub during an initial portion of the pistons upward movement to its upper position.

* * * * *